United States Patent [19]

Rogers

[11] 4,004,092

[45] Jan. 18, 1977

[54] COLOR TELEVISION PICTURE TUBES WITH IMPROVED IMPLOSION PROTECTION SYSTEM

[75] Inventor: Melvin F. Rogers, Western Springs, Ill.

[73] Assignee: Zenith Radio Corporation, Chicago, Ill.

[22] Filed: Oct. 20, 1975

[21] Appl. No.: 623,852

[52] U.S. Cl. ..... 358/246; 220/2.1 A

[51] Int. Cl.[2] ..... H01J 29/87

[58] Field of Search ..... 178/7.8, 7.82; 220/2.1 A

[56] References Cited

UNITED STATES PATENTS

| | | | |
|---|---|---|---|
| 3,207,936 | 9/1965 | Wilbanks et al. | 220/2.1 A |
| 3,845,530 | 11/1974 | Platt | 178/7.82 X |

*Primary Examiner*—Robert L. Richardson

*Attorney, Agent, or Firm*—John R. Garrett

[57] ABSTRACT

This disclosure depicts a novel edgebond system for implosion protecting a color television picture tube having a flangeless faceplate and a mating funnel. The edgebond system is illustrated as comprising, in its most general sense a high tensile strength metal scalloped frame which is cemented to and binds up a portion of the funnel and also the edge surface of the faceplate, i.e., the thickness dimension of the faceplate. The system assists in retaining in position the shards of a shattered faceplate and thereby provides for a relatively gradual buildup of pressure in the tube and provides for a maximum overlay of the funnel and a maximum volume of cement at the center of the sides of the funnel to provide greatest implosion protection at portions of the tube where greatest protection is needed.

4 Claims, 3 Drawing Figures

COLOR TELEVISION PICTURE TUBES WITH IMPROVED IMPLOSION PROTECTION SYSTEM

CROSS REFERENCE TO RELATED APPLICATION

This application relates to, but is in no way dependent upon, copending applications of common ownership herewith, including: Ser. No. 623,854, filed Oct. 20, 1975; Ser. No. 623,853, filed Oct. 20, 1975; Ser. No. 639,741, filed Oct. 20, 1975; Ser. No. 718,631, filed Aug. 30, 1976, Ser. No. 714,055, filed Aug. 16, 1976; and Ser. No. 632,559, filed Nov. 17, 1975.

BACKGROUND OF THE INVENTION

This invention relates in general to color television picture tubes and in particular to a system for implosion protecting such tubes. Conventionally, a color television picture tube has a glass bulb including a funnel, a flanged faceplate sealed to the flared end of the funnel, and an electron gun assembly mounted in the funnel neck for providing a source of cathode rays. The faceplate has a concave inner surface on which is deposited an electron-excitable phosphor screen. After the faceplace is sealed to the funnel, the glass bulb is evacuated and as a result, several tons of atmospheric pressure is exerted against the external surface of the faceplate. A glass bulb of this type is subject to implosion. The term "implosion" is defined by Underwriters Laboratory Incorporated as "rapid and sudden inward bursting of a high-vacuum glass envelope," It is of the utmost importance in the interest of safety to prevent the faceplate from violently shattering should it be struck for example, by a heavy missle, for when a bulb implodes fragments of glass may fly forwardly from the tube into the viewing area.

Three basic approaches for implosion protecting color cathode ray tubes (CRT's) have evolved. These three approaches employ different principles of operation. One approach is implemented in systems referred to as "rimbond" systems. The rimbond system has a scalloped metal frame which surrounds the flange found on every conventional faceplate. The gap between the frame and the faceplate flange is filled with a cement—typically an epoxy cement. In a rimbond system, the frame is not under tension. The cement holds in position the pieces of glass of a shattered faceplate long enough for air to enter the tube through the cracks formed so that pressure builds up in the tube relatively slowly. This prevents unacceptable amounts of glass from being projected forwardly from the tube although the tube may still collapse. Patents illustrating such rimbond systems are U.S. Pat. Nos. 3,485,407; 3,558,818; 3,412,203, and 3,835,250. A major drawback to such rimbond systems has been the large amounts of very costly epoxy cement needed to adhere the metal frame to the faceplate.

A second basic implosion protection approach is termed the "tension band" approach. Systems implementing this approach comprise a strap or band which is placed around the faceplate flange and put under very high tensile force. Numerous patents have been issued on various aspects of tension band systems. See U.S. Pat. Nos. 3,818,557; 3,777,057, 3,845,530; 3,890,464. The tension band systems, however, also have several drawbacks. When the tension band is tightened about the faceplate flange, it is very likely that the glass will be scratched as the band moves across it during the tightening process. This creates flaws at the location of the scratches, increasing the possibility of cracks forming there during implosion. Also, the distribution of forces applied to the faceplate flange by the band is irregular. Specifically, the forces applied at the corners by the band are much greater than the forces applied at the sides of the faceplate flange. The third approach is to bond a transparent protection shield over the front surface of the faceplate. Systems following this approach are commonly termed "bonded panel" systems. The bonded panel systems have no pertinence to this invention and therefore will not be discussed further.

A U.S. Pat. No. 2,222,197 to Engels discloses a CRT in which the CRT envelope comprises a curved flangeless faceplate inset in an expanded open end of a cooperating funnel. A band allegedly providing implosion protection surrounds the funnel near the open end thereof in a plane intersecting the faceplate ensconsed within the funnel mouth. The Engels system is quite different from the present system. No frame of any sort is provided. The implosion band environs the funnel rather than the faceplate peripheral edge. A comparison of the Engels system and present system will reveal other important differences, also.

This invention is believed to be most useful when applied to a tube having a flangeless faceplate. This tube is disclosed in U.S. Pat. No. 3,894,260, issued to the assignee of this application. The tube has a flangeless, curved glass faceplate, a concave inner surface of which receives a phosphor screen. The funnel portion of this unique tube has a convex seal land which matches and mates with the curvature of the concave inner surface of the faceplate.

OBJECTS OF THE INVENTION

It is an object of the present invention to provide for a color television picture tube an improved system for implosion protection.

It is another object of the present invention to provide an effective and low cost implosion protection system for a novel color television picture tube having a flangeless faceplate.

DESCRIPTION OF THE PREFERRED EMBODIMENT

Figure 1:
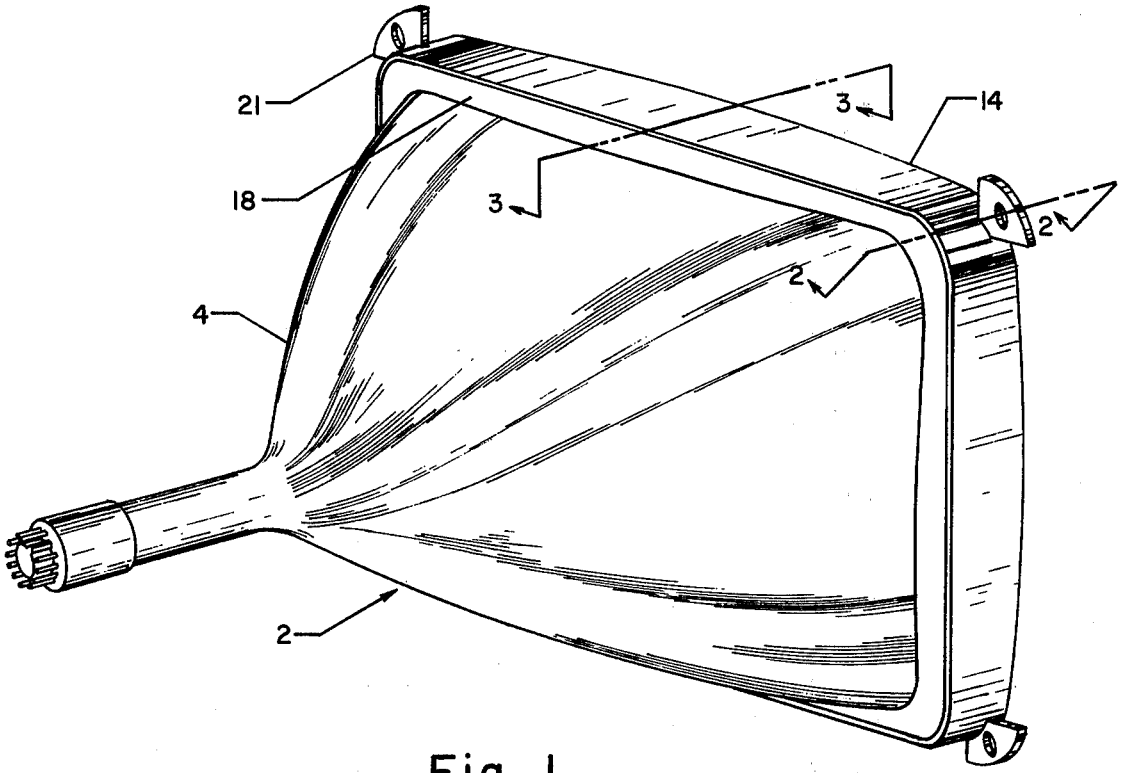
FIG. 1 is a perspective view of a color cathode ray tube embodying the present invention.
Figure 2:
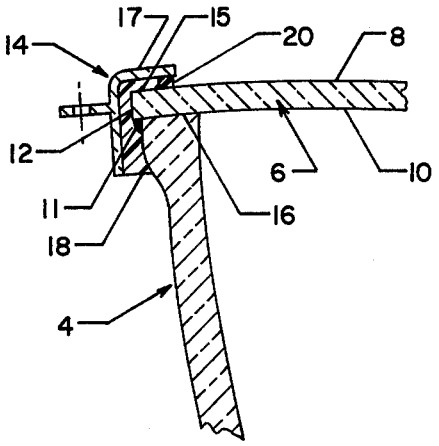
FIG. 2 is an enlarged schematic fragmentary side section view of the FIG. 1 tube, taken along lines 2—2 in FIG. 1.
Figure 3:
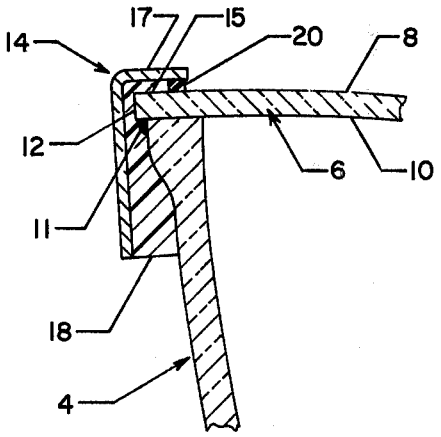
FIG. 3 is an enlarged schematic fragmentary side section view of the FIG. 1 tube, taken along lines 3—3 in FIG. 1.

Whereas the invention may be implemented in color cathode ray tubes of various types, it is preferably embodied in a tube of the nature shown in FIGS. 1–3. The tube 2, has an envelope comprising a funnel 4 sealed to a flangeless faceplate 6. The novel construction of the faceplate 6 without a flange permits economies in manufacture of the envelope and simplified and economical screening and assembly processes. The faceplate 6 has a curved configuration which may be spherical, multiradial, cylindrical, or of other suitable curvature. The faceplate 6 has a convex front surface 8 connected to a concave rear surface 10 by a peripheral edge surface 12. The edge surface 12 is contoured, that is, the edge surface portions along sides of the faceplate depart from and return to a plane connecting the four corners of the faceplate.

The funnel 4 has a convex seal land, herein intended to mean a seal land which lies on an imaginary curved surface which surface curvature may be spherical, multi-radial, cylindrical, or of other suitable curved configuration. The seal land of the funnel 4 is curved to match and mate with the concave rear surface 10 of the faceplate 6 along a sealing interface 16. The seal land of the funnel 4 is hermetically bonded to the rear surface 10 of the faceplate 6 by a devitrifying glass solder herein termed a "frit material"11.

The concave rear surface 10 of the faceplate 6 is here shown as being slightly larger than the wide end of the funnel 4 to which the faceplate 6 is attached. Thus, when the tube 2 is assembled, the faceplate overhangs the funnel slightly. Alternatively, the faceplate edge surface 12 may be flush with the outside surface of the funnel 4. The tube 2 when impacted on the faceplate is most susceptable to fracture near the center of the sides thereof.

The present invention will now be described. As described, relevant prior art systems used on conventional flanged faceplate tubes followed either of two approaches; 1) the "rimbond" approach wherein a portion of the outside surface of the faceplate flange is cemented to a surrounding variable depth frame; and 2) the "tension band" approach wherein the flange is compressed tightly by a high tension band. This invention involves a unique approach to implosion protection. For the first time by this invention, there is provided an edgebond implosion protection system for a color CRT in which the thickness dimension of the faceplate as well as a portion of the funnel are bound up and held by a cemented frame, the system providing a maximum overlay of the funnel and a maximum volume of cement at the center of the sides of the funnel so that greatest implosion protection occurs at portions of the tube where greatest protection is needed. A novel edgebond implosion protection system constructed according to this invention is illustrated in FIGS. 1–3.

A high tensile strength frame 14 surrounds and overlies the peripheral edge surface 12 of the faceplate 6. The forward portion of the frame 14 has a contour corresponding generally to that of the edge surface 12 of the faceplate 6 whereas the rear portion of the frame 14 lies substantially in a plane and overlies a portion of the funnel 4. That is, the front-to-back depth of the frame 14 increases markedly at the sides of the tube 2, as compared to the corners of the tube 2, creating a wedge shaped gap around the tube between the frame 14 and the overhung portions of the funnel 14. The wedge-shaped gap is filled with a cement 18, preferably an epoxy-type which not only is an extremely effective bonding agent, but is electrically insulative. As will become evident, the use of an electrically insulative cement obviates the customary operation of wrapping the sealing interface between the funnel and faceplate with insulative tape to electrically insulate the sealing interface.

A novel color television picture tube of the type described above is structurally stronger at the corners of the funnel as compared to the sides of the funnel. Since the frame covers a greater portion of the funnel at the center of the sides of the tube and the described wedge-shaped gap is larger there than at the corners, an increased amount of cement may be applied between the tube sides and the frame than between the tube corners and the frame. Thus the system provides enhanced implosion protection where it is needed most—at the sides of the tube. A very effective implosion protection system results. In order to reduce the amount of cement and to reduce the cost of the system a filler such as sand, gravel, or other suitable material can be inserted in the gap prior to (or after) introducing the cement into the gap. It has been observed that the use of gravel as a filler does not appreciably affect the effectiveness of the implosion protection afforded by the system.

Although not necessary, it is preferable that the frame 14 has a lip 17 which overlies a small marginal portion 15 of the convex front surface 8 of the faceplate 6.

To assemble the system, the frame is placed in its correct position with respect to the faceplate 6 and the cement 18 is introduced into the gap between the frame 14 and the edge surface 12 of the faceplate 6 and also into the gap between the frame 14 and the funnel 4. A gasket 20 disposed between the lip 17 and the marginal portion 15 of the surface 8 prevents the cement 18 from flowing onto the convex front surface 8 of the faceplate 6; other suitable methods also may be used to prevent the cement 18 from flowing onto the front surface 8.

A major advantage of the frame 14 described above with a planar rear portion is that a liquid epoxy of low viscosity can be used. With the tube 2 in a face-down position the epoxy can be simply poured into the gap between the frame 14 and the tube 2. The tube 2 is left in this position until the epoxy has solidified. Thus this fillability factor of the present invention provides for economies and ease in manufacturing.

As illustrated in FIG. 1, mounting tabs 21 for attaching the tube 2 to a cabinet may be included as part of the frame 14. In the preferred embodiment the tabs 21 extend from the corners of the frame 14 and have provisions such as holes for permitting attachment of the tube to the cabinet. Alternatively, these tabs could be placed anywhere about the frame or formed in a way which would best suit the type of cabinet being used.

An important and radically different aspect of this edgebond implosion-protection structure is that the frame 14 and frame-contained cement 18 embrace and bind up the entire edge surface 12 of the faceplate 6. In a preferred execution, the cement 18 embraces and binds up not only the entire edge surface 12, but a small portion 15 of the convex front surface 8, the sealing interface 16 and a portion of the funnel 4. It is desirable that the cement covers the sealing interface for two reasons. First, the implosion protection afforded by the system is improved. Second, the epoxy cement being a good electrical insulator, insulates the sealing interface and obviates the customary wrapping of the sealing interface with insulative tape.

In effect, the edgebond structure according to this invention embraces and binds up the actual thickness dimension of the faceplate 6, thereby effectively holding together the pieces of the faceplate when it is shattered long enough to allow air to enter the tube 2 slowly and also providing a maximum overlay of the funnel and a maximum volume of cement at the center of the sides of the funnel which provides greatest implosion protection at portions of the tube where greatest protection is needed. The internal pressure in the tube is thus caused to increase gradually preventing unacceptable amounts of glass fragments from being thrown forwardly from the shattered tube.

Underwriters laboratories Incorporated ("UL") sets the standards for implosion protected cathode ray tubes for television receiving equipment. The test employed by UL is generally as follows: The color television picture tube is mounted in a test cabinet enclosure of a specified size (depends on the size of the tube). The cabinet is supported on a 30 inches high, rigid, table-like test stand. Two barriers each ½ inch thick, 9½ inches high and 72 inches long are placed on edge on the floor in front of the test stand. The barriers are located at distances of 3 ft. and 5 ft., respectively, from the plane of the front enclosure of the cabinet. The three areas bounded by the barriers are indicated as follows: Zone 1: 0–3 ft., Zone 2: 3–5 ft., Zone 3: 5 ft. and beyond. The ball impact test is defined as follows: An impact is to be applied to any point on the face of the tube 1½ away from the edge of the screen area and is to be obtained from a solid, smooth, steel sphere 2 in diameter and weighing approximately 1.18 lbs. The sphere is to be suspended by a suitable cord and allowed to fall freely as a pendulum from rest through a distance necessary to cause it to strike with an impact of 5 foot-pounds. The cabinet supporting the cathode ray tube is to be placed so that the surface tested is vertical and in the same vertical plane as the point of support of the pendulum. When a tube is tested as described above, the amount of glass thrown forward shall not exceed the following. First, there shall be no single piece of glass weighing more than ½ oz. in Zone 2; second, the total weight of all the pieces of glass in Zone 2 shall not exceed 1½ oz.; and third, there shall be no single piece of glass in Zone 3 weighing more than 0.05 oz.

One embodiment (for a 23 inches diagonal tube) of the invention has been constructed. From the preliminary test results, it is expected that the tube will successfully pass the implosion protection tests of the Underwriters Laboratory Incorporated (described above). This embodiment comprised a steel frame with a thickness in the range 0.025 to 0.030 inch, a corner depth of approximately 1¼, a maximum side depth of about 2½ (FIG. 3) and a lip 17 overlapping the front surface of the faceplate of approximately ⅜ inch. The gap between the frame 14 and the edge surface 12 of the faceplate 6 was about ⅛ inch, the edge surface of the faceplate having a width of 0.450 inch. A liquid type A epoxy was introduced into the gap so as to cover the edge surface, the sealing interface 16 and the overhung portion of the funnel as well as the marginal portions 15, 13 of the front and rear surface 8, 10 of the faceplate. The gasket 20 of foam rubber tape approximately ⅛ thick was used with an adhesive for attaching it to the frame 14.

From preliminary tests, this tube is expected to pass the afore-discussed UL test.

The invention is not limited to the particular details of construction of the device depicted and other modifications and applications are contemplated. For example, whereas the above-depicted embodiment included an approximately spherical or multi-radial faceplate, the invention may be applied to other types of tubes having a contoured faceplate edge surface and sealing interface — e.g., a tube having a flangeless cylindrical faceplate. Certain other changes may be made in the above-described device without departing from the true spirit and scope of the invention herein involved. It is intended therefore that the subject matter in the above depiction shall be interpretative as illustrative and not in a limiting sense.

What is claimed is:

1. A color television picture tube having a glass bulb with an approximately rectangular, flangeless, curved faceplate having a convex front surface through which television pictures are viewed, a concave rear surface with a phosphor screen deposited on a portion thereof, and a peripheral edge surface connecting the convex front surface and the concave rear surface of the faceplate, the peripheral edge surfaces being contoured that is, having sides which depart from and return to a plane connecting the four corners of the faceplate, the glass bulb also having a funnel having a convex seal land which mates with the concave inner surface of the faceplate to define a contoured sealing interface, said bulb when impacted on said faceplate being most susceptable to fracture near the center of the sides thereof, said tube including a low cost edgebond implosion protection system comprising:

a high tensile strength metal frame which surrounds said edge surface of said faceplate and which overlies a portion of said funnel so that a wedge shaped gap is formed around the bulb between said frame and said portion of said funnel wherein the front-to-back frame depth increases to a maximum at the center of the sides; and a cement between said frame and said bulb, said cement and said frame binding up said edge surface of said faceplate, whereby said system providing a maximum overlay of said funnel and a maximum volume of said cement at the center of the sides of said funnel provides greatest implosion protection at portions of said tube where greatest protection is needed.

2. A color television picture tube having a glass bulb with an approximately rectangular, flangeless, curved faceplate having a convex front surface through which television pictures are viewed, a concave rear surface with a phosphor screen deposited on a portion thereof, and a peripheral edge surface connecting the convex front surface and the concave rear surface of the faceplate, the peripheral edge surface being contoured, that is, having sides which depart from and return to a plane connecting the four corners of the faceplate, the glass bulb also having a funnel having a convex seal land which mates with the concave inner surface of the faceplate to define a contoured sealing interface, said bulb when impacted on said faceplate being most susceptable to fracture near the center of the sides thereof, said tube including a low cost edgebond implosion protection system comprising:

a scalloped, high tensile strength, metal frame which surrounds said edge surface of said faceplate and which overlies a portion of said funnel so that a wedge shaped gap is formed around the bulb between said frame and said portion of said funnel wherein the front-to-back frame depth increases to a maximum at the center of the sides; and a cement between said frame and said bulb, said frame and said cement binding up said edge surface whereby said system providing a maximum overlay of said funnel and maximum volume of said cement at the center of the sides of said funnel provides greatest implosion protection at portions of said tube where greatest protection is needed.

3. A color television picture tube having a glass bulb with an approximately rectangular, flangeless, curved faceplate having a convex front surface through which television pictures are viewed, a concave rear surface with a phosphor screen deposited on a portion thereof, and a peripheral edge surface connecting the convex front surface and the concave rear surface of the faceplate, the peripheral edge surface being contoured, that is, having sides which depart from and return to a plane connecting the four corners of the faceplate, the glass bulb also having a funnel having a convex seal land which mates with the concave inner surface of the faceplate to define a contoured sealing interface, said bulb when impacted on said faceplate being most susceptable to fracture near the center of the sides thereof, said tube including a low cost edgebond implosion protection system comprising:

a high tensile strength metal frame which surrounds said edge surface of said faceplate and which overlies a portion of said funnel so that a wedge shaped gap is formed around the bulb between said frame and said portion of said funnel wherein the front-to-back depth increases to a maximum at the center of the sides; and a cement between said frame and said bulb, said cement and said frame embracing and binding up the entire edge surface of said faceplate, a small marginal portion of said convex front surface, said sealing interface, and said portion of said funnel whereby said system providing a maximum overlay of said funnel and maximum volume of said cement at the center of the sides of said funnel provides greatest implosion protection at portions of said tube where greatest protection is needed.

4. A color television picture tube having a glass bulb with an approximately rectangular, flangeless, three-dimensionally curved faceplate having a convex front surface through which television pictures are viewed, a concave rear surface with a phosphor screen deposited on a portion thereof and a peripheral edge surface connecting the convex front surface and the concave rear surface of the faceplate, the peripheral edge surface being contoured, that is, having sides which depart from and return to a plane connecting the four corners of the faceplate, the glass bulb also having a funnel with a convex seal land which mates with the concave inner surface of the faceplate to define a sealing interface and which is sealed to said faceplate with a frit material, said bulb when impacted on said faceplate being most susceptible to fracture near the center of the sides thereof, said tube including a low-cost edgebond implosion protection system comprising:

a scalloped, high tensile strength metal frame which surrounds said edge surface of said faceplate and overlies a small marginal portion of said front surface of said faceplate and which overlies a portion of said funnel so that a wedge shaped gap is formed around the bulb between said frame and said portion of said funnel wherein the front-to-back frame depth increases to a maximum at the center of the sides; and an electrically insulative epoxy-type cement between said frame and said bulb which with said frame embraces and binds up the entire surface, said sealing interface, a small marginal portion of said convex front surface, and said portion of said funnel whereby said system providing a maximum overlay of said funnel and maximum volume of said cement at the center of the sides of said funnel provides greatest implosion protection at portions of said tube where greatest protection is needed, said cement also serving to electrically insulate said sealing interface.

* * * * *